US005853335A

United States Patent [19]

Self

[11] Patent Number: 5,853,335

[45] Date of Patent: Dec. 29, 1998

[54] PITCHING AND CHIPPING GOLF GAME AND TRAINING DEVICE

[76] Inventor: Harry Lee Self, 226-130th Pl. NE., Bellevue, Wash. 98004

[21] Appl. No.: 845,501

[22] Filed: Apr. 24, 1997

[51] Int. Cl.[6] ..... A63B 69/36

[52] U.S. Cl. ..... 473/196; 473/172

[58] Field of Search ..... 473/196, 173, 473/170, 150, 153, 172, 195, 197

[56] References Cited

U.S. PATENT DOCUMENTS

| | | | |
|---|---|---|---|
| 1,262,314 | 4/1918 | Downey, W.H.J. . | |
| 2,455,185 | 11/1948 | May, M.D. . | |
| 2,988,363 | 6/1961 | Hall, R.M. . | |
| 3,202,429 | 8/1965 | Richman, A.S. . | |
| 3,366,387 | 1/1968 | Koener, R.F. . | |
| 3,366,388 | 1/1968 | Del Raso, A. . | |
| 3,424,463 | 1/1969 | Matthews, G.G. . | |
| 3,558,140 | 1/1971 | Romeo, P. . | |
| 3,844,558 | 10/1974 | Gigliotti, V.J. . | |
| 3,856,313 | 12/1974 | Tierney, D.P. . | |
| 4,281,834 | 8/1981 | Chavez | 473/196 |
| 4,368,888 | 1/1983 | Ren, G.J. . | |
| 4,989,876 | 2/1991 | Hawkings, A. et al. . | |
| 5,383,667 | 1/1995 | Sheely | 473/196 |
| 5,407,203 | 4/1995 | Jones, W.M. . | |
| 5,586,941 | 12/1996 | Klearman, M. . | |

*Primary Examiner*—Mark S. Graham
*Attorney, Agent, or Firm*—Graybeal Jackson Haley LLP

[57] ABSTRACT

A golf game and training device which involves pitching and chipping golf balls at a target that has a plurality of numbered scoring positions. The device includes a target base having target walls the define an upper target area mounted on top of three legs which also function as targets. The target legs are associated with a target skirt that defines a lower target area. A vertical beam target extends upward from a back target wall and an aperture in the target base allows a ball to pass from the upper target area into a ball receptacle. An indoor ball and pitching/chipping mat allow the device to be used indoors or out without damaging the playing surface.

15 Claims, 3 Drawing Sheets

PITCHING AND CHIPPING GOLF GAME AND TRAINING DEVICE

FIELD OF THE INVENTION

The present invention relates generally to a golf game and training device, and more particularly to a golf game and training device which simulates pitching and chipping.

BACKGROUND OF THE INVENTION

The widespread popularity of golf stems in part from the fact that players can relax and enjoy the outdoors while engaging in friendly competition with one another. However, the sport of golf also requires a great deal of practice in order to develop proficiency. The ideal golf game would be enjoyable to play and help develop skills that can be applied at a golf course.

There are an abundance of golf game devices and golf training devices used for either entertainment or skill development. However, most golf games have little or nothing to do with golf and in many instances may actually teach poor habits. Furthermore, most golf training devices are not much fun to use and therefore often fall into disuse.

The majority of golf games are best described as "putting games". Typically a putter is used to putt a ball through an opening or up a ramp into a ball receiving depression. While these games may develop putting skills, they do absolutely nothing to develop pitching or chipping skills.

Prior art golf games and training devices which teach pitching and chipping skills have often been large complicated devices that are quite expensive, take up a great deal of space, and are difficult to move once they are set up. Other prior art "pitching games" are designed to be played indoors and use substitute clubs and balls.

One prior art game involves a wall mounted target mat with graphics depicting a green, bunkers and rough. The player pitches Velcro covered whiffle balls at the wall target and tries to get the balls to stick to the target as close to the flagstick as possible. While this game may be enjoyable as an indoor alternative it is of dubious use as a training aid and would probably not work well outside due to the low mass of the specialized ball.

SUMMARY OF THE INVENTION

The present invention is a golf game and training device which allows the player to use his own clubs and a standard golf ball to pitch and chip balls at a target either as a game or part of a training exercise. The inventive device can be used by an individual to develop pitching and chipping skills or by a group as a game of skill.

The preferred embodiment includes a back wall target, a front wall target, side wall targets, a base target, a ball receptacle target, a vertical beam target and a skirt target. Each target is assigned a particular point value. The arrangement of the targets and the point values assigned to them correspond to the difficulty of the pitch or chip required to hit the target. A target that is difficult to hit has a higher point value associated with it than a target that is easier to hit. Alternatively, targets can be assigned point values such that more difficult shots are awarded lower point values and the object is to get the lowest possible score as in a traditional game of golf.

When used as a training device the player chips or pitches balls at the targets in an attempt to strike the vertical beam target or land the ball in the ball receptacle. This is especially useful for new players because it provides a clear objective.

They know immediately if they are pitching or chipping well or whether they need to adjust their shot. Keeping track of points is useful for someone using the device for training purposes as it provides the player with a method of keeping track of their improvement.

When used as a group game, players take turns pitching or chipping balls at the target and keep track of how may points are scored. As a group game the target is used to play a variety of "holes" from different distances and scores are kept for each shot. Typically points will be scored based upon the first point of contact or where the ball ends up. Each player keeps track of his scores on a scorecard similar to golf and at the end of the game the scores are totaled and the person with the highest point total (or the lowest depending upon numbering) wins.

The preferred embodiment of the present invention has the advantage of being easily set up and portable golf game and training device which may be played either outdoors or indoors. The present invention has the further advantage of being able to be used by a single player or a group. If a light weight ball is substituted for a standard golf ball the device may be used to play the game or practice pitching and chipping indoors or where outdoor space is limited. While training with the light weight ball is not as good as playing with a traditional golf ball, the exercise still provides the player with valuable feedback about face angle, launch angle and swing path.

These and other features of the present invention will be more fully appreciated when considered in light of the following detailed description and drawings.

DETAILED DESCRIPTION OF THE INVENTION

Figure 1:
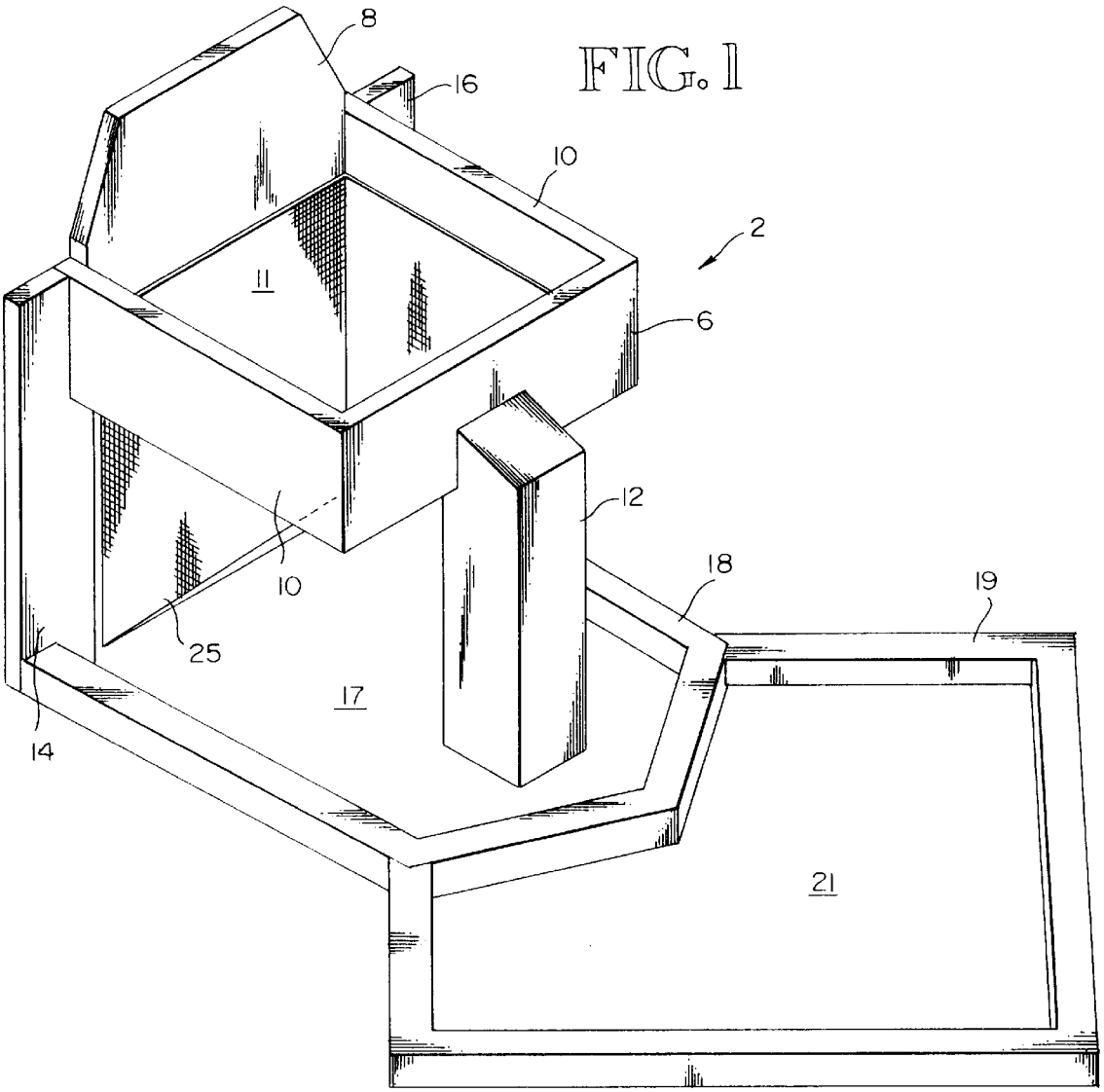
FIG. 1 is an isometric view of the golf pitching and chipping game of the present invention incorporating a skirt target.
Figure 2:
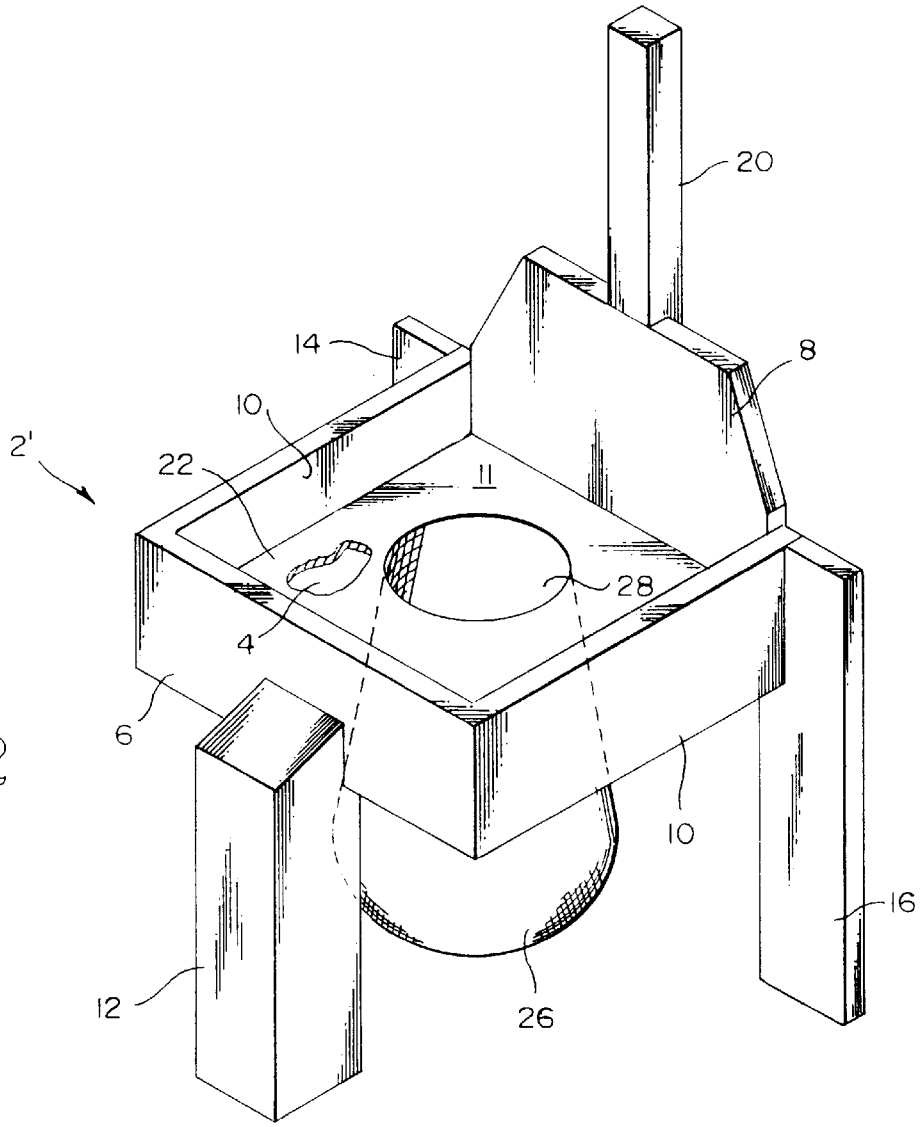
FIG. 2 is an isometric view of an alternate embodiment of the golf pitching and chipping game of the present invention incorporating an upper vertical beam target.

FIGS. 1 and 2 illustrate the preferred embodiment of the inventive golf game and training device 2 which is comprised of target base 4 from which extends upward front target wall 6, back target wall 8, and side target walls 10. The target walls thereby define recessed upper target area 11. Target base 4 is mounted on top of front target leg 12, left target leg 14, and right target leg 16. A skirt target 18 extends forward from the lower front edge of said left and right target legs 14 and 16. The skirt target 18 extends forward of front target leg 12 and thereby defines lower target area 17. The skirt target 18 is further comprised of a forward skirt target 19 which defines forward target area 21. A vertical beam target 20 extends upward from back target wall 8.

In FIG. 1, upper target area 11 is open to ball recepticle 25 which is mounted along the lower edge of the target walls 6, 8, and 10 and between left target leg 14 and right target leg 16.

In FIG. 2, the target base 4 is also provided with a target base aperture 24, a ball receptacle 26, and a shock absorbent mat 22 having a mat aperture 28 in registration with target base aperture 24.

The target base 4, front target wall 6, back target wall 8, and side target walls 10 can be formed as a single piece or assembled from multiple pieces of wood or other suitable material. In the preferred embodiment, the entire device 2 or 2' is constructed out of wood except for the shock absorbent mat 22 (see FIG. 2) and the ball receptacle 26. The shock absorbent mat 22 is manufactured from any number of well known shock absorbing materials such as polyurethane and serves the purpose of reducing the bounce of a golf ball out of the upper target area 11. In the preferred embodiment point values (not shown) for the various targets are painted on the inventive device 2.

Figure 3:
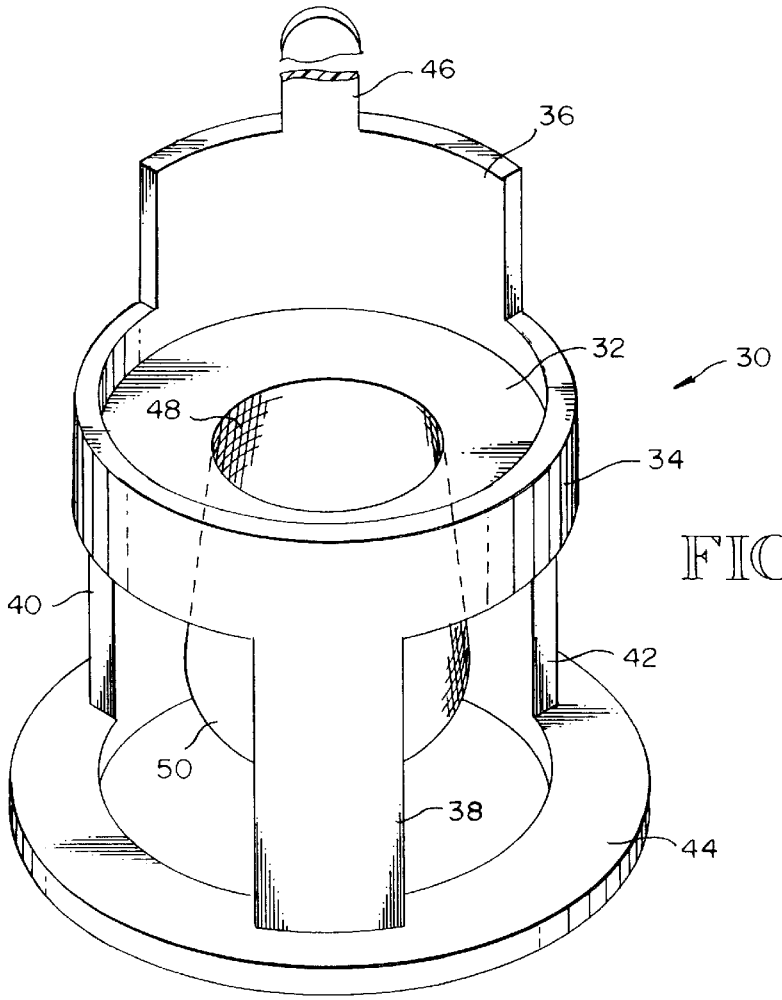
FIG. 3 is an isometric view of another alternate embodiment of the golf pitching and chipping game of the present invention incorporating a skirt target and upper vertical beam target.

FIG. 3 illustrates an alternate embodiment 30 of the inventive golf game comprising a circular target base 32 which has a target wall 34 extending circumferentially upward and defining a recessed upper target area 35. A back target wall 36 extends above the height of the remaining target wall 34. The circular target base is mounted on front target leg 38, left target leg 40 and right target leg 42. Target legs 38, 40, and 42 are mounted on circular skirt target 44. The interior portion of circular skirt target 44 defines lower target area 45. A vertical beam target 46 extends upward from back target wall 36 and circular target base 32 is provided with a target base aperture 48 and a ball receptacle 50.

Figure 4:
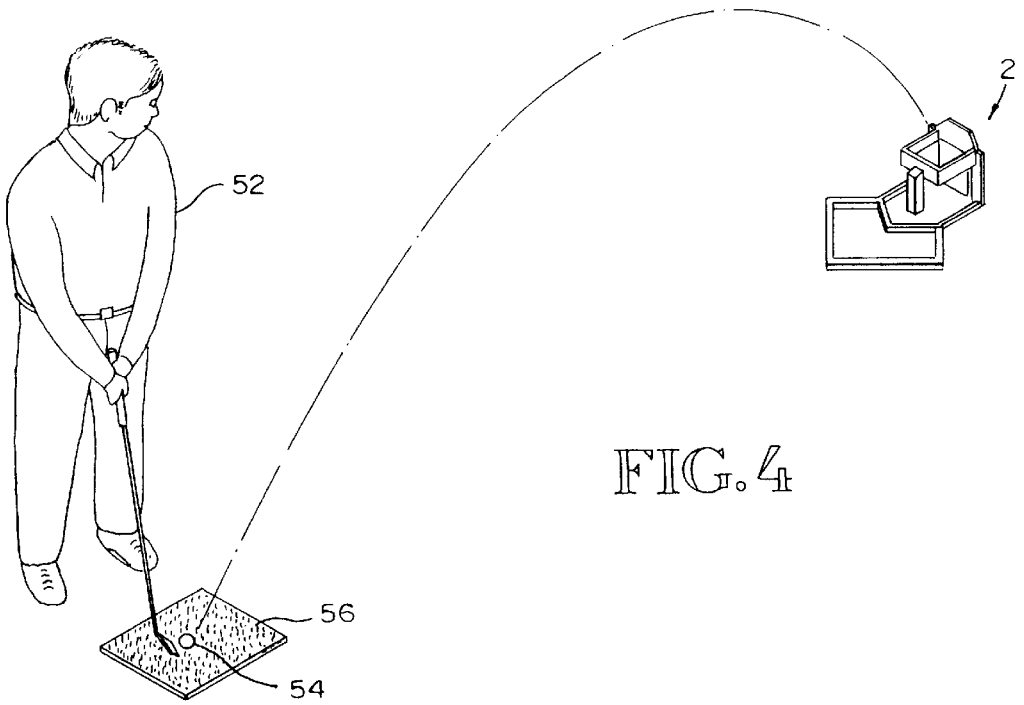
FIG. 4 is a perspective view of a manner in which the present invention may be used.

FIG. 4 illustrates a golfer 52 pitching or chipping an indoor ball 54 off of a pitching/chipping mat 56 toward inventive golf game 2. The indoor golf ball 54 has the same dimensions as standard golf ball but is considerably lighter and may be padded or hollow and have a plurality of holes uniformly distributed across its surface (more commonly referred to as a whiffle ball). The pitching/chipping mat 56 prevents damage to the players clubs, floors, and keeps the grass from getting chewed up.

From the foregoing, it will be appreciated that a new, novel, and nonobvious golf game and training has been disclosed. It is to be understood that numerous alternatives and equivalents will be apparent to those of ordinary skill in the art, given the teachings herein, such that the present invention is not to be limited by the foregoing description but only by the appended claims.

I claim:

1. A golf game and training device for developing pitching and chipping skills comprising:

a) a target base having a topside and underside, a forward edge, a rear edge, a left side edge, and right side edge, wherein the intersection of said rear edge and said left side edge define a left rear corner and the intersection of said rear edge and said right side edge define a right rear corner and from which extends upward a front target wall, a back target wall, and side target walls so as to form a recessed upper target area and thereby define an interior upper target area;

b) a front target leg depending from the center of the forward edge of said target base;

c) a left target leg depending from the left rear corner of said target base;

d) a right target leg depending from the right rear corner of said target base; and e) a skirt target extending forward from the lower side of said left target leg and connecting to the lower side of said right target leg and thereby partially enclosing a lower target area therebetween.

2. The device of claim 1, wherein said skirt target is comprised of a plurality of rectangular segments extending forward from said left and right target legs and are arranged so said front target leg is within said lower target area.

3. The device of claim 1, further comprising a vertical beam target extending upward from the center of said back target wall.

4. The device of claim 1, further comprising a shock absorbing mat sized and configured to be removably mountable within said recessed upper target area.

5. A golf game and training device for developing pitching and chipping skills comprising:

a) a target base having a topside and an underside, a forward edge, a rear edge, a left side edge, and right side edge, wherein the intersection of said rear edge and said left side edge define a left rear corner and the intersection of said rear edge and said right side edge define a right rear corner and from which extends upward a front target wall, a back target wall, and side target walls so as to form a recessed upper target area and thereby define an interior upper target area; wherein said target base is provided with a target base aperture sized so as to allow a ball to pass through said target base aperture; wherein said aperture has the same dimensions as the interior of said recessed upper target area;

b) a front target leg depending from the center of the forward edge of said target base;

c) a left target leg depending from the left rear corner of said target base;

d) a right target leg depending from the right rear corner of said target base; and e) a ball receptacle suspended from the underside of the target base and positioned so as to receive a ball passing through said target base aperture.

6. The device of claim 5, wherein said ball receptacle is manufactured from a flexible material.

7. A golf game and training device for developing pitching and chipping skills comprising:

a) a target base having a topside and an underside, a forward edge, a rear edge, a left side edge, and right side edge, wherein the intersection of said rear edge and said left side edge define a left rear corner and the intersection of said rear edge and said right side edge define a right rear corner and from which extends upward a front target wall, a back target wall, and side target walls so as to form an recessed upper target area and thereby define an interior upper target area; said target base is provided with a target base aperture sized so as to allow a ball to pass through said target base aperture;

b) a front target leg depending from the center of the forward edge of said target base;

c) a left target leg depending from the left rear corner of said target base; and d) a right target leg depending from the right rear corner of said target base;

e) a skirt target extending forward from the lower side of said left target leg and connecting to the lower side of said right target leg and thereby partially enclosing a lower target area therebetween; and f) a vertical beam target extending upward from the center of said back target wall.

8. The device of claim 7, further comprising a ball receptacle suspended from the underside of the target base and positioned so as to receive a ball passing through said target base aperture.

9. The device of claim 8, further comprising a shock absorbing mat sized and configured to be removably mountable within said recessed upper target area and provided with a mat aperture in registration with said target base aperture.

10. The device of claim 7, further comprising an indoor golf ball.

11. The device of claim 7, further comprising a pitching and chipping mat sized and configured so as to allow a ball to be pitched or chipped from said mat without damaging an underlying surface.

12. A golf game and training device for developing pitching and chipping skills comprising:

a) a circular target base having a topside and an underside, from which extends upward and circumferentially a target wall; said target wall forming a cylinder, the interior of which defines an upper target area; wherein a rear portion of said target wall extends upward beyond the height of adjacent target wall portions so as to form a back target wall;

b) a front target leg depending from the center of the forward edge of said target base;

c) a left target leg depending from a left rear position along the circumference of said target base:

d) a right target leg depending from a right rear of said target base; and e) a circular skirt target depending from said target legs and defining a lower target area within the area of the circle.

13. The device of claim 12, further comprising a vertical beam target extending upward from the center of said back target wall.

14. The device of claim 12, wherein said target base is provided with a target base aperture sized so as to allow a ball to pass through said target base aperture.

15. The device of claim 14, further comprising a ball receptacle suspended from the underside of the target base and positioned so as to receive a ball passing through said target base aperture.

* * * * *